US006823925B2

(12) United States Patent
Militello et al.

(10) Patent No.: US 6,823,925 B2
(45) Date of Patent: Nov. 30, 2004

(54) RETRACTABLE WINDOW SHADE WITH HEIGHT ADJUSTMENT CONTROL

(75) Inventors: David Ronald Militello, Rohnert Park, CA (US); Barry L. Shevick, Fair Oaks, CA (US)

(73) Assignee: Shades Unlimited, Inc., Cotati, CA (US)

( * ) Notice: Subject to any disclaimer, the term of this patent is extended or adjusted under 35 U.S.C. 154(b) by 0 days.

(21) Appl. No.: 10/194,193

(22) Filed: Jul. 12, 2002

(65) Prior Publication Data

US 2004/0007333 A1 Jan. 15, 2004

(51) Int. Cl.[7] ..... E06B 9/322
(52) U.S. Cl. ..... 160/170
(58) Field of Search ..... 160/170, 171, 160/168.1 P, 176.1 P, 84.02, 84.06, 84.01, 84.04, 173 R; 185/39, 45; 242/378.4, 373

(56) References Cited

U.S. PATENT DOCUMENTS

| | | | | | |
|---|---|---|---|---|---|
| 4,271,893 | A | | 6/1981 | McCluskey | |
| 4,597,430 | A | * | 7/1986 | Marquez | 160/269 |
| 4,758,042 | A | | 7/1988 | Liu | |
| 4,836,265 | A | | 6/1989 | Bussert | |
| 5,025,848 | A | | 6/1991 | Prochaska | |
| 5,105,867 | A | * | 4/1992 | Coslett | 160/84.04 |
| 5,158,127 | A | | 10/1992 | Schumacher | |
| 5,279,473 | A | | 1/1994 | Rozon | |
| 5,354,011 | A | | 10/1994 | Rozon | |
| 5,762,281 | A | | 6/1998 | Foley | |
| 5,915,442 | A | | 6/1999 | Prosch | |
| 6,024,154 | A | * | 2/2000 | Wang et al. | 160/170 |
| 6,029,734 | A | * | 2/2000 | Wang et al. | 1/1 |
| 6,149,094 | A | * | 11/2000 | Martin et al. | 242/373 |
| 6,283,192 | B1 | * | 9/2001 | Toti | 160/170 |
| 6,289,965 | B1 | * | 9/2001 | Ruggles | 160/173 R |
| 6,330,899 | B1 | * | 12/2001 | Ciuca et al. | 160/170 |
| 6,508,293 | B1 | * | 1/2003 | Huang | 160/170 |
| 6,571,853 | B1 | | 6/2003 | Ciuca et al. | |
| 6,575,223 | B1 | * | 6/2003 | Chung et al. | 242/378.4 |
| 6,601,635 | B2 | * | 8/2003 | Ciuca et al. | 160/192 |
| 2002/0033241 | A1 | | 3/2002 | Palmer | |
| 2002/0088562 | A1 | | 7/2002 | Palmer | |
| 2002/0157796 | A1 | | 10/2002 | Judkins | |
| 2003/0085002 | A1 | | 5/2003 | Palmer | |
| 2003/0111191 | A1 | * | 6/2003 | Ciuca et al. | 160/170 |

OTHER PUBLICATIONS

Peel 'N Stick Vinyl Temp Shade; Temp Shade, 2455 Paces Ferry Road, N. W., Atlanta, GA 30339; Made in China.

* cited by examiner

*Primary Examiner*—Blair M. Johnson
(74) *Attorney, Agent, or Firm*—Heisler & Associates

(57) ABSTRACT

A height adjustment control is provided for a retractable window shade. The window shade includes a top beam and a bottom beam with the bottom beam suspended below the top beam by at least one cord. The bottom beam can be adjusted and positioned relative to the top beam by adjustment of a length of cord extending between the top beam and the bottom beam. The height adjustment control system of this invention acts on the portions of the cord which are not suspended between the top beam and the bottom beam. A retainer is provided to gather up portions of the cord which are not in use. A retractor exerts a force on the retainer to cause the retainer to automatically gather up this excess cord. A cord brake is provided to hold the cord from passing onto the retainer and hold the bottom beam at a desired position below the top beam.

38 Claims, 4 Drawing Sheets

RETRACTABLE WINDOW SHADE WITH HEIGHT ADJUSTMENT CONTROL

FIELD OF THE INVENTION

The following invention relates to systems for retracting a window shade from a lower position occluding a greater portion of a window to an upper position occluding less of the window, and vice versa. More particularly, this invention relates to systems for maintaining cords of a window shade in the proper position to support the window shade at a desired height and with the cord maintained in a fashion free of susceptibility to jamming, tangling or other damage.

BACKGROUND OF THE INVENTION

Windows are often fitted with shades or blinds to control the passage of light through the windows. Shades are generally the category of window covering which provides a continuous layer of fabric or other material which can be raised to allow light to pass through the window or lowered to block, at least partially, light passing through the window. Blinds are generally referred to as a related device which when in a lowered position only partially blocks the passage of light through the window, in either a fixed or adjustable "Venetian blind" configuration.

For both shades and blinds, together referred to as window shades, numerous prior art devices are known to raise, lower and control the height of the window shade within the frame surrounding the window. Many such window shade height adjustment control systems include one or more cords with the cords generally coupled between a top edge and a bottom edge of the window shade. Shortening of the cord raises the window shade and lengthening of the cord lowers the window shade.

When a portion of the cord between the top edge and the bottom edge of the window shade is shortened, this cord must go somewhere, typically dangling freely outside of the window shade. This excess cord can pose a risk of serious injury to small children or animals, resulting in numerous attempts in the prior art to collect this excess cord extending outside of the window shades. For instance, see U.S. Pat. Nos. 4,271,893, 5,279,473, 5,354,011 and 5,762,281.

SUMMARY OF THE INVENTION

This invention provides a retractable window shade with height adjustment control that utilizes cords for such height adjustment control but which largely contains and manages the cords internally within the various structures of the window shade. The cords pose no risk of injury and are maintained in a fashion which prevents damage to the cords and disabling of the retraction and height adjustment control mechanisms of the window shade. The window shade of this invention includes a shade element extending between a top edge and a bottom edge. At least one cord is provided with an upper end adjacent the top edge and with a lower end adjacent a portion of the shade element spaced below the top edge, typically adjacent the bottom edge of the shade element.

A cord retainer is located along the cord, typically at the lower end of the cord and adjacent the bottom edge of the shade element. The retainer is preferably configured as a spool which is rotatably supported relative to the bottom edge of the shade element. The spool can thus rotate to gather the cord onto the spool and retain portions of the cord which are not needed as the bottom edge of the shade element is raised up towards the top edge of the shade element, such as when the window shade is raised.

A cord retractor is provided to bias the retainer toward having the cord entirely loaded upon the spool. This cord retractor is selectively activatable, so that when the retractor is activated the spool or other retainer can gather the cord onto the spool, and when deactivated the spool or other retainer does not draw the cord onto the retainer and the height of the window shade is held constant.

The selective activatability of the retractor can be provided, such as with a cord brake to hold the cord relative to the spool or other retainer and prevent the spool or other retainer from drawing more of the cord onto the spool. In a preferred form of the invention, the retractor biases the spool or other retainer toward having more of the cord upon the retainer. The retractor is configured to include a spring which stores energy when the cord is largely off of the spool or other retainer and releases energy to cause the spool or other retainer to rotate or otherwise be loaded with the cord when a large portion of the cord is off of the spool or other retainer, such as when the window shade is in a lower position with a large portion of the cord used to extend between the top edge and the bottom edge of the shade element.

The cord brake or other selectively activatable retractor activation mechanism is preferably manually adjustable by pushing buttons adjacent the bottom edge of the shade element. When these buttons are depressed, the cord brake is released and the retainer is biased to draw up the cord onto the retainer. If manual forces are simultaneously applied to the bottom edge of the shade element to lift the bottom edge of the shade element, the cord is retracted onto the retainer as the bottom edge of the shade element is raised.

Alternatively, if the bottom edge of the shade element is pulled down while the button of the cord brake or other manual control for the selectively activatable retractor is activated, the biasing forces on the retainer can be overcome by the user and the bottom edge of the shade element pulled down away from the top edge, thereby increasing energy stored in the retractor for later gathering of cord when the window shade is later raised. When the buttons of the cord brake, or other selectively activatable retractor, are released the cord brake is activated and the cord retractor deactivated so that the window shade can maintain a stationary position where it is left.

OBJECTS OF THE INVENTION

Accordingly, a primary object of the present invention is to provide a window shade which includes at least one cord extending between a top edge of the shade element and a portion of the shade element below the top edge, and with excess portions of the cord retained safely for later use.

Another object of the present invention is to provide a retractable window shade which can be readily manually raised and lowered without requiring the handling of cords manually.

Another object of the present invention is to provide a window shade which can be readily raised and lowered without cords dangling freely where they can be damaged or pose a safety hazard.

Another object of the present invention is to provide a retractable window shade which can have a height thereof readily manually adjusted to a desired height.

Another object of the present invention is to provide a retractable window shade which exhibits highly reliable performance.

Other further objects of the present invention will become apparent from a careful reading of the included drawing figures, the claims and detailed description of the invention.

DESCRIPTION OF THE PREFERRED EMBODIMENT

Figures 1, 2, 3:
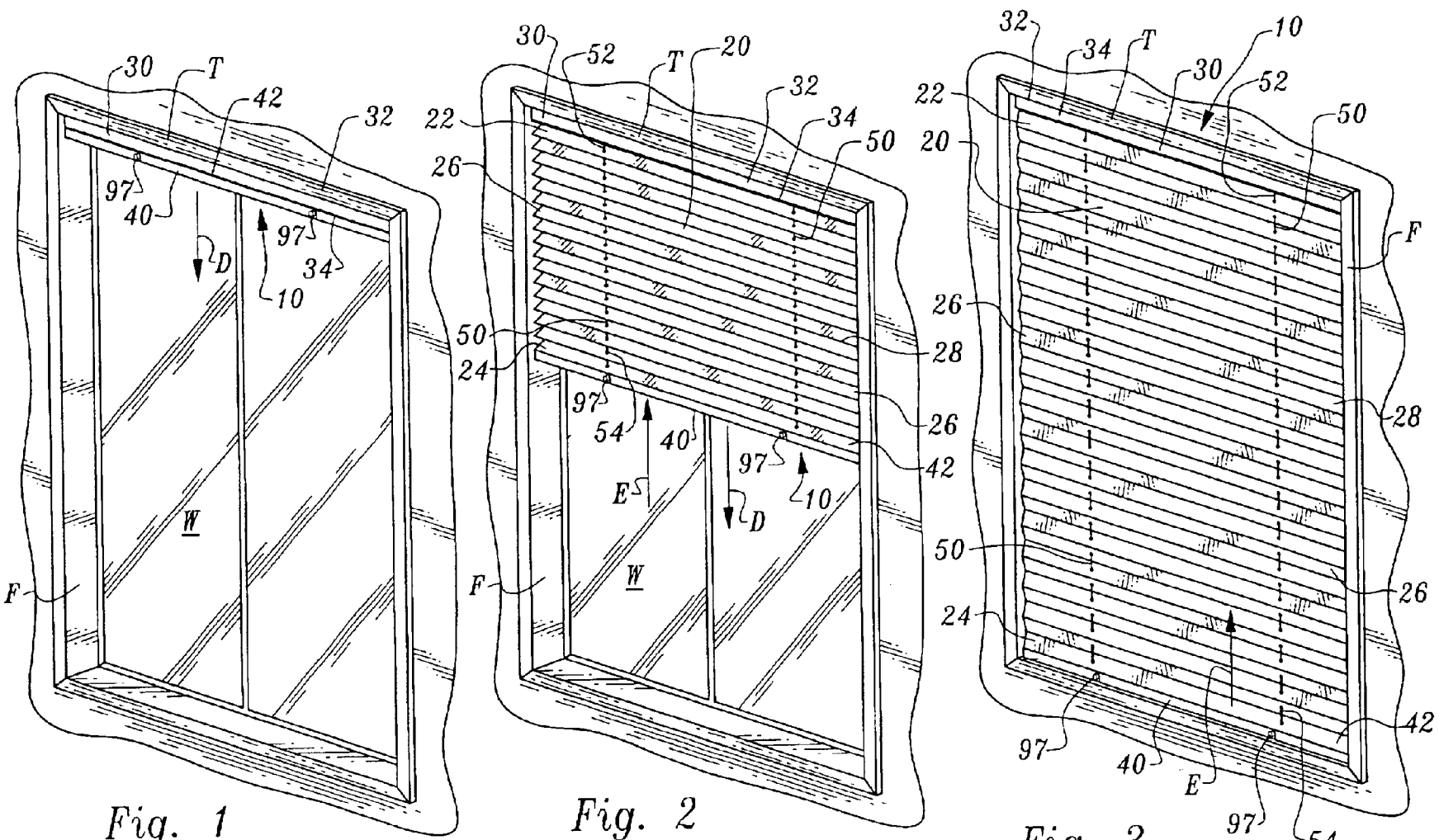
FIG. 1 is a perspective view of a window with the retractable window shade of this invention installed thereon and in a fully raised position.
FIG. 2 is a perspective view similar to that of FIG. 1 but with the retractable window shade shown in an intermediate position between the raised position of FIG. 1 and a lowered position of FIG. 3.
FIG. 3 is a perspective view of that which is shown in FIG. 1 but with the retractable window shade shown in a fully lowered position.

Referring to the drawings, wherein like reference numerals represent like parts throughout the various drawing figures, reference numeral 10 is directed to a window shade including the retractable height adjustment control features of this invention. The window shade 10 is adapted to be oriented adjacent a window W (FIG. 1) inside of a frame F surrounding the window W and adjacent a top T portion of the frame F. The window shade 10 can be adjusted in height to leave the window W substantially unobstructed (FIG. 1), totally covered (FIG. 3) or at an intermediate height selected by the user (FIG. 2).

Figure 5:
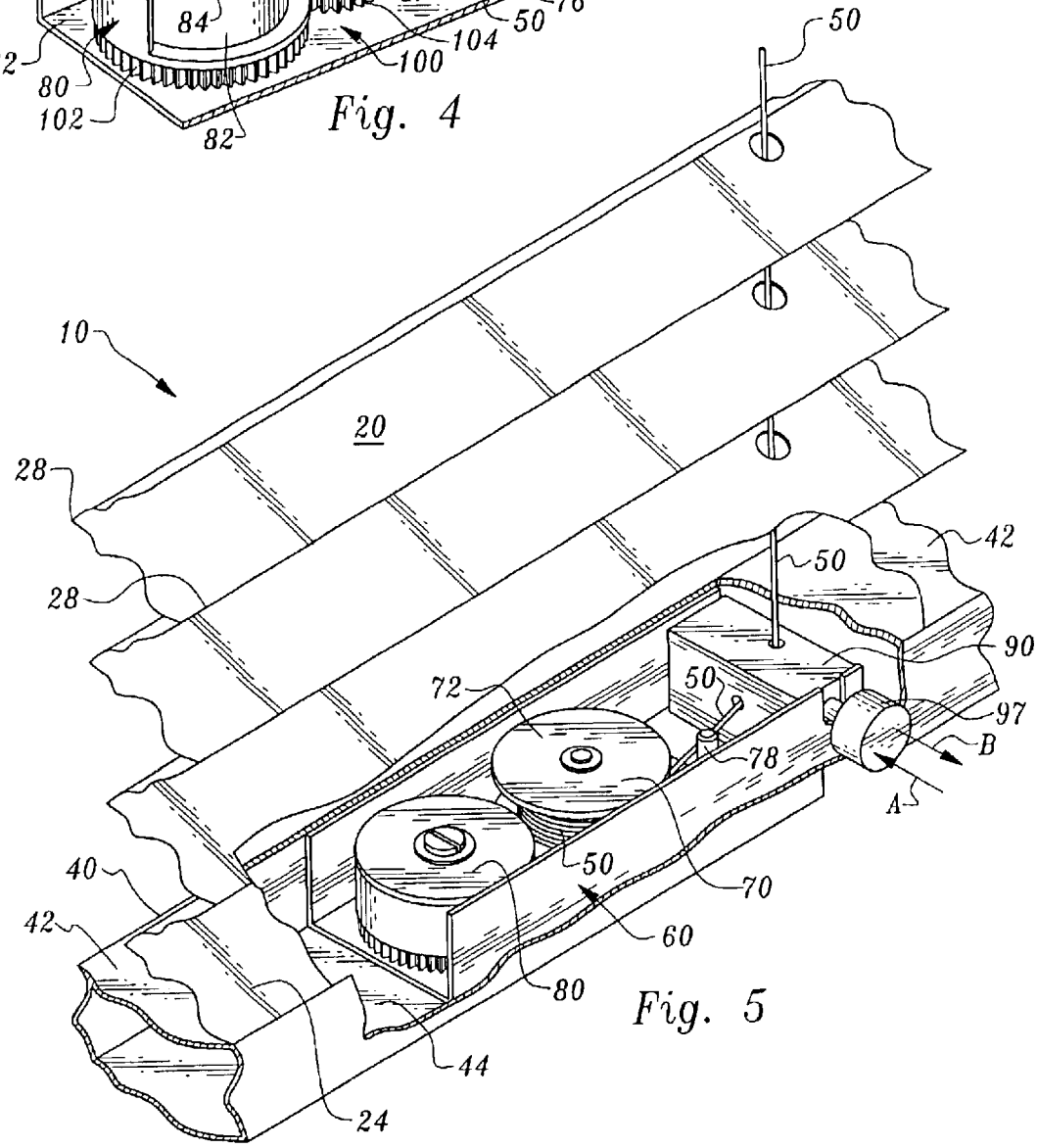
FIG. 5 is a perspective view similar to that which is shown in FIG. 4 but with the cord maintenance platform and related elements mounted within a bottom beam of the retractable window shade to illustrate how the mechanism of FIG. 4 is integrated into the retractable window shade such as that shown in FIGS. 1–3.

In essence, and with particular reference to FIGS. 2 and 5, the basic details of the window shade 10 with the height adjustment control of this invention are described. The window shade 10 includes a shade element 20 for at least partially occluding the passage of light through the window W adjacent the window shade 10. The shade element 20 preferably includes a rigid top beam 30 supporting a top edge 22 of the shade element 20. A bottom beam 40 is preferably provided to support a bottom edge 24 of the shade element 20. The top beam 30 is affixed to the top T of the frame F adjacent the window W. At least one cord 50 (and preferably two cords 50) extends from the top beam 30 down to the bottom beam 40. The cord 50 has a length between the top beam 30 and the bottom beam 40 adjustable so that the cord 50 can lift the bottom beam 40 up towards the top beam 30 or lower the bottom beam 40 down from the top beam 30, to adjust the height of the bottom beam 40 and the amount of the window W which is occluded by the shade element 20.

The bottom beam 40 preferably supports a cord maintenance platform 60, such as within a hollow interior 44 of the bottom beam 40. The platform 60 includes a cord retainer 70, preferably in the form of a spool 72. The spool 72 can rotate to gather up portions of the cord 50 or release portions of the cord 50 so that portions of the cord 50 which are not needed to extend between the top beam 30 and the bottom beam 40 are carefully stored and maintained until needed.

A cord retractor 80 is also supported by the cord maintenance platform 60. The cord retractor 80 is selectively activatable to cause the retainer 70 to load or release the cord 50 when activated, and hold the cord 50 when deactivated. Most preferably, the retractor 80 is configured as a spring 82 (FIG. 4) with the spring 82 of the retractor 80 coupled to the spool 72 of the retainer 70, so that the retainer 70 is always biased toward having all of the cord 50 loaded onto the spool 72.

A cord brake 90 is provided to activate and deactivate the retractor 80. The cord brake 90 is preferably manually adjustable, such as with a button 97 extending out of the bottom beam 40 to cause the brake 90 to selectively hold or release the cord 50. When the cord is held by the cord brake 90, the cord 50 is prevented from being loaded onto the retainer 70 or pulled off of the retainer 70. When the cord brake 90 is released, such as by depression of the button 97, the cord 50 is allowed to be drawn onto the retainer 70 by action of the retractor 80. Alternatively, the cord 50 can be pulled off of the retainer 70 if forces generated by the retractor 80 are overcome by manual forces, such as those associated with a user pulling down on the bottom beam 40, to cause the shade element 20 to more completely occlude the window W. To maintain a low profile for the cord maintenance platform 60 and associated retainer 70 and retractor 80, the retainer 70 and retractor 80 are preferably oriented adjacent each other about parallel spaced centerlines, with a gear train 100 causing the retractor 80 and retainer 70 to be functionally attached together.

More specifically, and with particular reference to FIGS. 1–3 and 5, specific details of the shade element 20 and associated structures are described. The window shade 10 according to the preferred embodiment includes a shade element 20 which is in the form of a single sheet of flexible material. The shade element 20 includes a top edge 22 spaced from a bottom edge 24 with both the top edge 22 and bottom edge 24 extending horizontally between vertical side edges 26. Typically, the top edge 22 and bottom edge 24 are sufficiently spaced apart that the shade element 20 can entirely occlude a height of the window W. The side edges 26 are preferably spaced apart a width similar to a width of the window W so that complete coverage of the window W can be provided by the window shade 10.

With the shade element 20 of the preferred embodiment, pleats 28 are provided which extend horizontally between the side edges 26. The pleats 28 give the material forming the shade element 20 a "zig-zag" appearance when viewed from the side and facilitate vertical collapse or expansion of the shade 10.

While this basic form for the shade element 20 is provided in this preferred embodiment and is a simple structure to illustrate the height adjustment control features of this invention, various other shade elements could similarly be used with the height adjustment control features of this invention and are considered to be within the scope of this invention. For instance, the shade element 20 could be configured from multiple sheets of material with the separate sheets each pleated or attached to each other in various different patterns which are capable of expanding and collapsing in height vertically. With such alternative shades, a side view of the shade might be in the form of a series of rectangular cross-section pockets, square cross-section pockets, hexagonal cross-section pockets or other shapes.

The material forming the shade element 20 can be entirely opaque or partially transparent (or conceivably even completely transparent). The shade element 20 can be non-foraminous so that a continuous layer is provided with the shade element 20. Alternatively, the shade element 20 can include large or small holes passing through the shade element 20 and still be effective in practicing the unique height adjustment control features of this invention.

Additionally, the shade element 20 can be configured as a blind, rather than as a shade with the shade element 20 of the preferred embodiment substituted with a series of slats such as those provided with "Venetian blinds," or configured in the form of many other varieties of blinds as known in the art. With these alternative embodiments for the shade element 20, such alternatives would typically have some form of an edge corresponding with the top edge 22 of the shade element 20 and some form of edge corresponding with the bottom edge 24 of the shade element 20, as well as sides corresponding with the side edges 26 of the shade element 20. For convenience the simple pleated shade element 20 of the preferred embodiment is shown in the figures to illustrate and emphasize the height adjustment control features of the window shade 10 of this invention.

The shade element 20 of the preferred embodiment preferably includes a top beam 30 which provides a rigid structure coupled to the top edge 22 of the shade element 20. This top beam 30 includes an upper surface 32 and a lower surface 34. The lower surface 34 is preferably affixed to the top edge 22 of the shade element 20. The upper surface 32 can be configured to include an appropriate fastener to allow the top beam 30 to be attached to the top T of the frame F adjacent the window W. A preferred fastener is an adhesive of sufficient strength to support the weight of the entire window shade 10 suspended from the top T of the frame F. Alternative fasteners including tacks, screws, nails, staples and other known window shade 10 attachment fasteners could be utilized to allow the top beam 30 of the window shade 10 to be securely mounted to the top T of the frame F adjacent the window W.

The top beam 30 is not strictly necessary. Rather, the top edge 22 of the shade element 20 could function as the top beam 30 with rigidity for the window shade 10 provided by the frame F rather than by the top beam 30 or other structure forming a portion of the window shade 10. For instance, adhesive could be applied to a portion of the shade element 20 adjacent the top edge 22, so that the top edge 22 could be attached directly to the top T of the frame F.

Preferably, a bottom beam 40 is included in the window shade 10 adjacent the bottom edge 24 of the shade element 20. The bottom beam 40 includes an upper surface 42 coupled to the bottom edge 24 of the shade element 20. The bottom beam 40 is preferably rigid so that the bottom edge 24 of the shade element 20 is maintained in a horizontal or other linear orientation for desirable aesthetic appearance. As an alternative, the bottom edge 24 of the shade element 20 can be formed of sufficiently rigid material so that a separate bottom beam 40 is not required. Similarly, the bottom edge 24 could be allowed to sag or otherwise take on an irregular form so that the bottom beam 40 would not be required. Also, suspension cords or other stiffening agents could be utilized rather than the rigid bottom beam 40.

The bottom beam 40 of the preferred embodiment preferably includes a hollow interior 44 which is sufficiently large to contain the cord maintenance platform 60 which houses the various height adjustment control mechanisms of this invention. In this way, the bottom beam 40 acts to conceal and protect the various height adjustment control mechanisms of this invention.

At least one, and preferably two cords 50 extend between the top beam 30 and the bottom beam 40. Each cord 50 includes an upper end 52 securely attached to the top beam 30 or otherwise attached to the either the top edge 22 of the shade element 20 or directly to the top T of the frame F, such that the upper end 52 of the cord 50 is securely held in place. A lower end 54 of the cord 50 extends down from the upper end 52. The lower end 54 is coupled, at least indirectly, to the bottom beam 40 so that the bottom beam 40 of the window shade 10 is supported relative to the top beam 30 by being suspended from the cord 50.

Gravitational forces pulling down on the bottom beam 40 are held as a tension load on the cord 50 up through the upper end 52 of the cord 50 which is securely attached to the top T of the frame F either directly or through the top beam 30. With the shade element 20 of the preferred embodiment, the cord 50 is routed through holes between pleats 28 in the shade element 20, so that the cord 50 can extend vertically with the shade element 20 zig-zagging back and forth across the cord 50. The cord 50 thus additionally serves to keep the shade element 20 aligned as it folds up, such as during raising of the bottom beam 40 of the window shade 10.

The cord 50 is preferably a small diameter woven nylon cord which is substantially inelastic and flexible. However, the cord 50 could be any of a variety of materials including metallic fibers woven together, metallic wire, organic fibers or synthetic fibers, depending on the loads to be carried by the cord 50 and the functional characteristics desired in configuring the window shade 10 according to this invention.

The lower end 54 of the cord 50 is not affixed directly to the bottom beam 40 or the bottom edge 24 of the shade element 20 during typical operation of the window shade 10. Rather, the lower end 54 is held within the retainer 70. The cord brake 90 holds a portion of the cord 50 between the lower end 54 and the upper end 52 with the cord brake 90 coupled to the bottom beam 40 or otherwise coupled to the bottom edge 24 of the shade element 20. Thus, the entire cord 50 does not always function to carry the tensile load provided by the weight of the bottom beam 40 and portions of the shade element 20 below the top edge 22. Rather, only portions of the cord 50 between the upper end 52 and the cord brake 90 experience this tensile load to carry the weight of the bottom beam 40 up to the top beam 30. When the window shade 10 is in a raised configuration (FIG. 1) only a very small portion of the cord 50 functions to carry this tensile load. Conversely, when the window shade is in a lowered position (FIG. 3) nearly all of the cord 50 experiences this tensile load.

Figure 4:
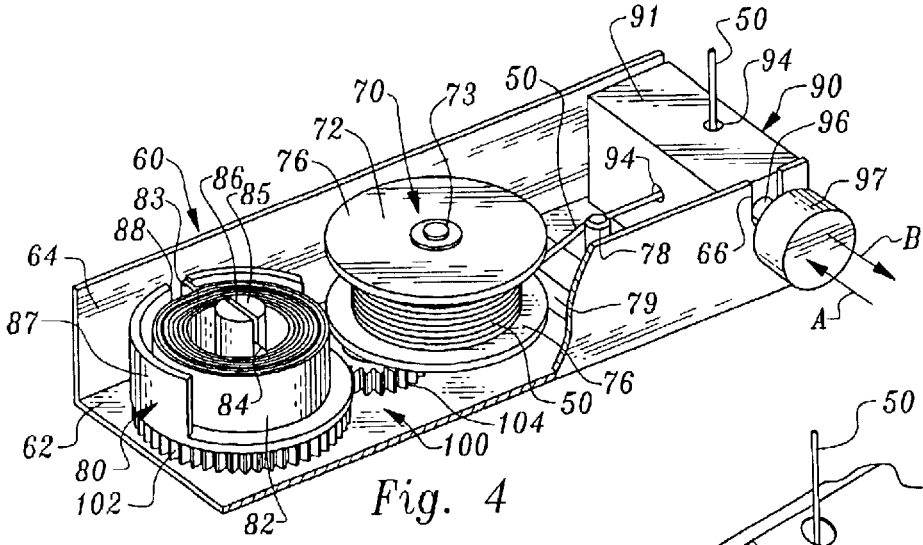
FIG. 4 is a perspective view of a cord maintenance platform, retainer, retractor and cord brake of this invention, with portions cut away to reveal interior details.

With particular reference to FIGS. 4 and 5, basic details of the height adjustment control system of this invention and its interface with the cord 50 and other portions of the window shade 10 are described. Preferably, the cord maintenance platform 60 is provided to support the retainer 70, retractor 80 and cord brake 90 within the hollow interior 44 of the bottom beam 40. The platform 60 is not strictly required, with the retainer 70, retractor 80 and cord brake 90 potentially supportable directly by the bottom beam 40 or from the bottom edge 24 of the shade element 20. With the platform 60 of the preferred embodiment, a rigid floor 62 of horizontal planar form is provided with vertical side walls 64 extending up from forward and rearward edges of the floor 62. A relief 66 is provided in one of the side walls 64 at an upper edge thereof, to provide a space through which a button 97 of the cord brake 90 can extend.

The retainer 70, retractor 80 and cord brake 90 preferably rest upon the platform 60 and provide for adjustment and maintenance of the cord 50 below the cord brake 90 and including the lower end 54 of the cord 50. The retainer 70, retractor 80 and cord brake 90 are described generally initially, in that various different mechanisms could be supplied which would provide the basic function of the retainer 70, retractor 80 and cord brake 90. A more detailed description of the specific preferred embodiment for the retainer 70, retractor 80 and cord brake 90 are then supplied.

The retainer 70 is configured to gather up and release portions of the cord 50 below the cord brake 90 and extending on to the lower end 54 of the cord 50. The retainer 70 thus keeps the cord 50 from having to dangle below the bottom beam 40 of the window shade 10 and keeps the cord 50 from getting tangled or binding. When positioning of the window shade 10 causes excess cord 50 to be located below the cord brake 90, the retainer 70 gathers up the excess cord 50 for safe keeping until later use of that portion of the cord 50 is required. When the window shade 10 is oriented so that additional cord 50 is needed above the cord brake 90, the retainer 70 releases an appropriate amount of cord 50 in a smooth fashion so that the window shade 10 can be positioned where desired.

The retainer 70 is preferably configured as a spool 72. The spool 72 thus provides one form of a means to retain the cord 50. However, the retainer 70 could alternatively be configured as an elongate path within the bottom beam 40 or as a series of pulleys or into some form of enclosure into which the excess cord 50 below the cord brake 90 is held.

The retractor 80 is supported upon the cord maintenance platform 60 along with the retainer 70. The retractor 80 provides the basic function of causing excess cord below the cord brake 90 to be directed into the retainer 70. The retractor 80 is preferably in the form of a spring 82 biasing the spool 72 of the retainer 70 toward a position with the cord 50 wound up upon the spool 72. The retractor 80 could take various alternative forms. For instance, the retractor 80 could be in the form of a motor coupled to the cord 50 in a fashion which would cause excess cord below the cord brake 90 to be drawn into the retainer 70. Such a motor retractor 80 could be between the cord brake 90 and the retainer 70 or could provide the combined function of the cord brake 90 and the retractor 70, such as in the form of a winch. In such a configuration, an electric switch would typically activate and control the blinds. Such a switch could be toggled manually or remotely, such as with a radio remote control transmitter and receiver. The retractor 80 could similarly be in the form of a resilient element, such as a rubber band, or some other form of resilient biasing device to exert a force on the cord 50 tending to deliver the cord 50 into the retainer 70. Such a force could be delivered directly to the cord 50 or delivered to the retainer 70 so that the retainer 70 is biased toward having as much as the cord 50 as possible drawn into the retainer 70. The retainer 70 is preferably selectively activatable. Such selective activatability is preferably provided by the cord brake 90.

The cord brake 90 provides the basic function of holding a midpoint of the cord 50 between the upper end 52 and the lower end 54 stationary relative to the bottom beam 40 or other corresponding structure of the window shade 10. The cord brake 90 thus defines a location on the cord adjacent which the bottom beam 40 or similar structure of the window shade 10 will be located and defines a height position for the window shade 10. The cord brake 90 of the preferred embodiment is configured as a shoe 98 within a body 91 (FIGS. 6–8) which pinches the cord 50 passing through the body 91 with sufficient force to hold the pinched portion of the cord 50 within the body 91. Other alternative forms of cord brake 90 could similarly be provided including integrating the cord brake 90 within the retainer 70 or retractor 80, such as by having a friction member engage the spool 72 of the retainer 70 to prevent the retainer 70 from rotating when such a brake is activated. If the retractor 80 is in the form of a winch-like electric motor functioning as both the retainer 70 and retractor 80, the cord brake 90 could take the form of the motor being configured to be locked to resist rotation unless activated. Other mechanical devices could similarly be used on the cord or on the retainer 70 or retractor 80, such as a pawl to selectively engage the cord 50, retainer 70, retractor 80 or gear train 100 between the retainer 70 and retractor 80.

With particular reference to FIGS. 6–9, the specific configuration for the preferred embodiment of the retainer 70, retractor 80 and brake 90 are described. Preferably, two separate complete height adjustment control mechanisms are provided on two separate cords 50 within the window shade 10. If only one cord 50 is provided within the window shade 10, only one such overall mechanism would be required. If three or more cords 50 are provided within the window shade 10, a corresponding number of height control mechanisms could be provided. Alternatively, it is conceivable that a single height control mechanism could, with appropriate modifications, be configured to simultaneously act on two or more cords 50, such as by routing both cords 50 through a common cord brake and into a common retainer or onto separate retainers with cord loading forces provided by either a single retractor or by multiple retractors.

The entire height control mechanism including the retainer 70, retractor 80 and cord brake 90 preferably rest upon a common cord maintenance platform 60 which can be securely fastened within the hollow interior 44 of the bottom beam 40 of the window shade 10. The retainer 70 is preferably in the form of the spool 72. The spool 72 has a central hole 73 aligned with a rotational axis of the spool 72. The central hole 73 resides around an axle 75 (FIG. 9) affixed to the floor 62 of the platform 60 and extending vertically up from the platform 60. The spool 72 thus preferably has a vertically oriented axis of rotation. The spool 72 includes a hub 74 between two rims 76. The hub 74 is preferably cylindrical in form with sufficient width between the rims 76 and sufficient depth away from tips of the rims 76 to allow substantially all of the cord 50 to be wound around the hub 74 and onto the spool 72 before exceeding a distance that the rims 76 extend away from the axis of rotation.

On occasion, the cord 50 might have a tendency to wrap around the hub 74 in a manner with successive turns of the cord 50 wrapping over previous turns of the cord 50, rather than successive turns of the cord 50 laying at least partially laterally along side previous turns of the cord 50. If this occurs, it is conceivable that the cord 50 would potentially climb up over the rims 76 and cause the cord 50 to become tangled or bind the retainer 70.

Figure 8:
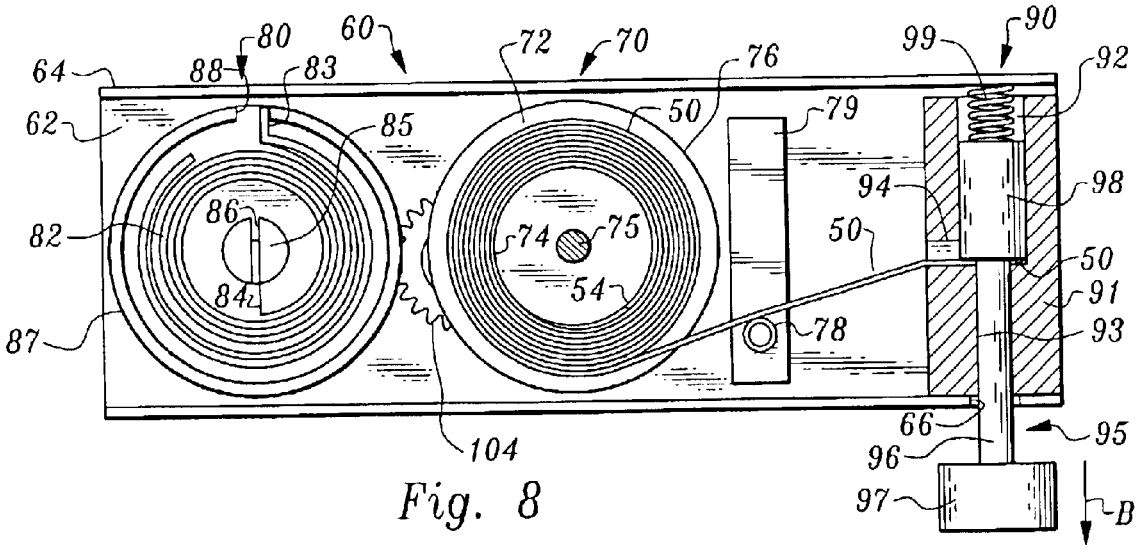
FIG. 8 is a top plan view similar to that which is shown in FIGS. 6 and 7 but with the cord brake engaged and with the spring of the retractor relaxed and the spool of the retainer full, such as when the retractable window shade is in the raised orientation of FIG. 1.

To prevent such cord 50 "stacking," and to encourage the cord 50 to lay along side previous turns to fully fill up the retainer 70, a post 78 is provided extending vertically up from a bar 79 resting on the floor 62. The post 78 is positioned to apply an additional force on the cord 50 tending to cause the cord 50 to seek a path closer to the hub 74, if the cord 50 works its way too far away from the hub 74. Particularly, as shown in FIG. 8, the cord 50 has become wound to a significant distance away from the hub 74. The cord 50 is abutting the post 78 and the post 78 is keeping the cord 50 from climbing further away from the hub 74. The bar 79 provides one form of post 78 support, while the post 78 could similarly extend up from the floor 62 of the platform 60. As an alternative to the post 78, any form of substantially vertical edge or surface can be positioned to abut the cord 50 of the cord 50 is excessively stacking onto the spool 72.

According to the preferred embodiment, the retainer 70 is biased to always have a force tending to draw the cord 50 onto the retainer 70. This biasing force is provided by the cord retractor 80 in the form of the spring 82. The spring 82 thus provides one form of a means to selectively retract the cord onto the retainer. While this spring 82 of the retractor 80 could be aligned about a common central axis with the retainer 70, to preserve the height of the overall cord maintenance platform 60, the spring 82 of the retractor 80 is preferably oriented adjacent the retainer 70 but to the side of the retainer 70 about a parallel spaced central axis.

The spring 82 is preferably of a spiral type with a first end 83 spaced from a second end 84. The spring 82 is preferably of a substantially constant force variety, with the spring 82 always maintained under at least partially compression. The spring 82 stores a variable amount of spool winding energy, depending on the amount of angular deflection of the spring 82. This first end 83 is preferably an outermost end of the spring 82. The second end 84, at an innermost portion of the spiral spring 82, is preferably coupled to a central shaft 85 affixed to the floor 62 of the platform 60 and extending vertically up from the floor 62 of the platform 60. The second end 84 is held to the central shaft 85, such as by orienting the second end 84 within a slit 86 in the central shaft 85. In this way, the second end 84 of the spring 82 is fixed relative to the platform 60, bottom beam 40 and window shade 10.

The entire spring 82 is preferably contained within a housing 87 which includes a notch 88 receiving the first end 83 of the spring 82 therein. The housing 87 includes a cap 89 so that the housing 87 completely contains the spring 82. The housing 87 can rotate relative to the platform 60, along with the first end 83 of the spring 82 when the cord 50 is being drawn onto the retainer 70 or being delivered off of the retainer 70.

Figure 6:
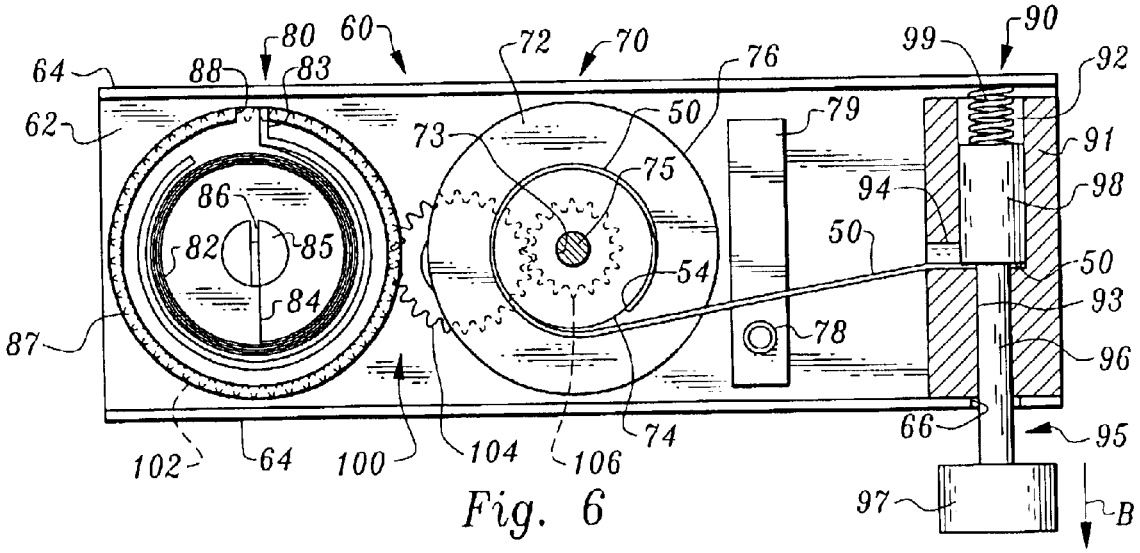
FIG. 6 is a top plan view of that which is shown in FIG. 4 with portions cut away to reveal the function of the cord retainer, cord retractor, and cord brake of this invention and with a gear train shown in hidden lines to illustrate interconnection of the cord retainer and cord retractor.
Figure 9:
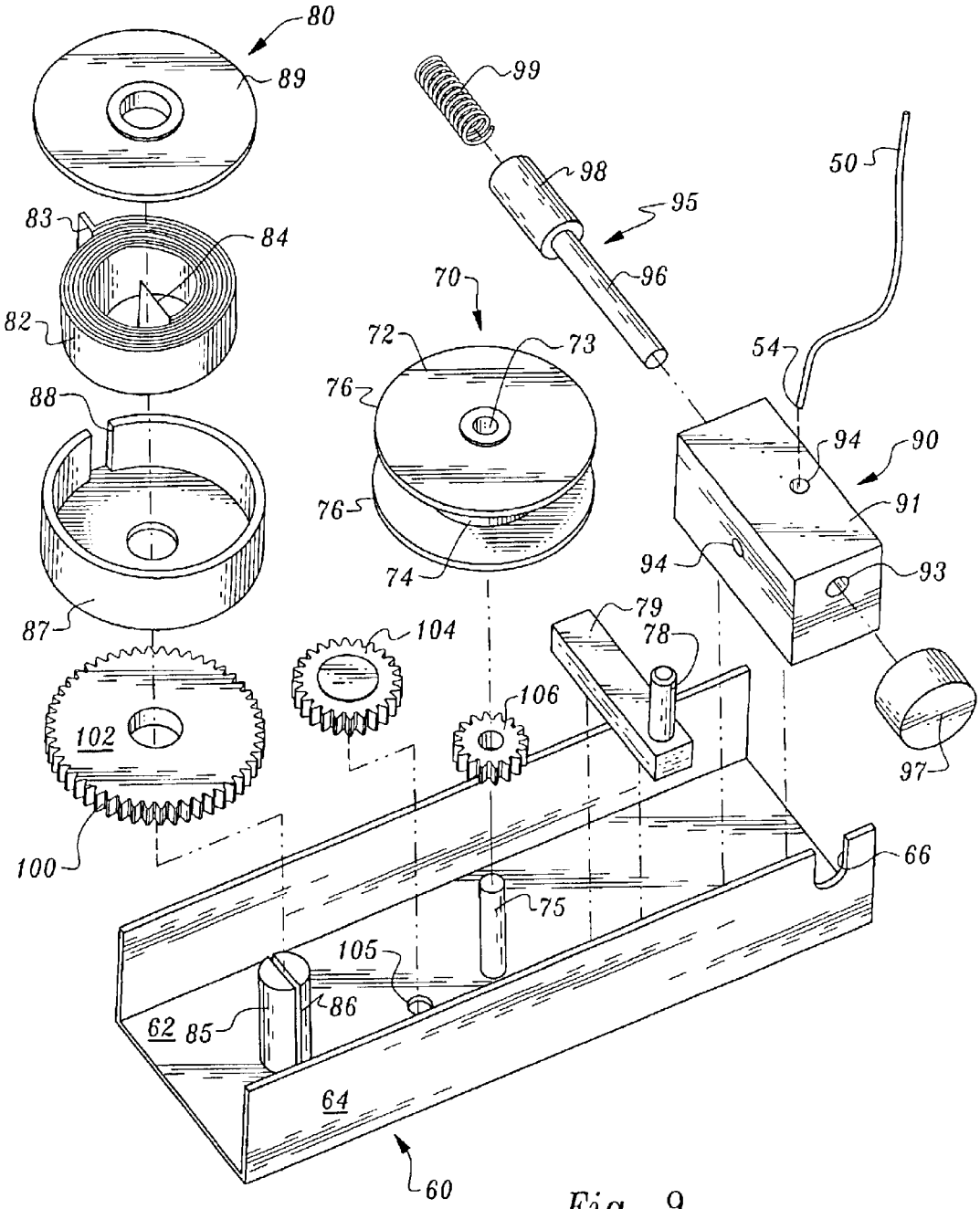
FIG. 9 is an exploded parts view of that which is shown in FIG. 4.

The retractor 80 is preferably coupled to the retainer 70 through a gear train 100 (FIGS. 6 and 9). The gear train 100 causes biasing forces of the retractor 80 to be exerted upon the retainer 70. Additionally, the gear train 100 preferably provides an approximately 3-to-1 ratio between rotation of the spring 82 and rotation of the spool 72. In this way, three rotations of the spool 72 will only cause one rotation of the spring 82 and a greater number of rotations of the spool 72 can be caused by a relatively simple spring 82 with a number of turns in the spiral spring 82 approximately one-third the number of turns required by the spool 72 to draw all of the cord 50 onto the spool 72.

The gear train 100 thus includes a drive gear 102 affixed to the housing 87, the drive gear 102 having a greatest number of teeth. The spool 72 includes a smaller follower gear 106 coupled thereto.

The follower gear 106 has an axis of rotation corresponding with the axis of rotation of the retainer 70. The drive gear 102 has an axis of rotation corresponding with an axis of rotation of the housing 87 and spring 82 of the retractor 80. An idler gear 104 is provided between the drive gear 102 and follower gear 106. A hole 105 is provided in the floor 62 of the platform 60 to rotatably support the idler gear 104 between the drive gear 102 and follower gear 106. Rotational forces thus pass through the gear train 100 from the drive gear 102, to the idler gear 104 and on to the follower gear 106. Because the follower gear 106 has approximately one-third the teeth of the drive gear 102, the 3-to-1 gear ratio is provided. Other gearing mechanisms could similarly be utilized including a rack and pinion type gear arrangement with the rack pulled by a linear spring functioning a retractor 80.

The retractor 80 functions with the cord brake 90 to control whether the retainer 70 is at rest or collecting/releasing cord 50. Specifically, when the cord brake 70 is engaged, the retractor 80 is effectively deactivated. Conversely, when the cord brake 90 is released, the retractor 80 is effectively activated. The cord brake 90 thus acts with the retractor 80 to provide one form of a means to selectively retract the cord 50 and load the cord 50 onto the retainer 70.

The cord brake 90 is preferably located within the platform 60 and conveniently on a side of the retainer 70 opposite the retractor 80. The cord brake 90 both acts to hold the cord 50 relative to the platform 60 and associated bottom beam 40 of the window shade 10, and also acts as a sheave to allow the cord 50 to rotate from its vertical orientation within the window shade 10 to a substantially horizontal orientation extending from the cord brake 90 to the retainer 70.

The cord brake 90 is preferably configured as a body 91 in the form of a rigid mass of material with a large bore 92 extending into one end of the body 91 and a small bore 93 extending into an opposite end of the body 91. The small bore 93 and large bore 92 join together within an interior of the body 91. A tunnel 94 is provided which provides a path for the cord 50 through the body 91 of the cord brake 90. The tunnel 94 extends down into the body 91 at a top surface and out of the body 91 through a side surface. This tunnel 94 passes into the large bore 92 adjacent where the large bore and small bore 93 come together.

An assembly 95 is provided which fits within the large bore 92 and small bore 93. The assembly 95 includes a rod 96 having a diameter similar in size to that of the small bore 93, a button 97 at an end of the rod 96 which extends out of the small bore 93 and out of the body 91, and a shoe 98 at an end of the rod 96 opposite the button 97. The shoe 98 has a diameter similar to that of the large bore 92 so that the shoe 98 resides within the large bore 92 with the rod 96 extending through the small bore 93 and the button 97 connected to a portion of the rod 96 extending out of the small bore 93 and out of the body 91.

The cord 50 is routed through the tunnel 94 and between the shoe 98 and an end of the large bore 92 adjacent the small bore 93. The cord 50 can thus be readily pinched between the shoe 98 and the end of the large bore 92. The assembly 95 and especially the shoe 98 is biased toward a cord 50 grasping and holding configuration by a bias spring 99 trapped between a surface of the shoe 98 opposite the rod 96 and one of the side walls 64 of the platform 60. The bias spring 99 is a compression spring which exerts a force on the shoe 98 pinching the cord 50 between the shoe 98 and the bottom of the large bore 92 within the body 91. When the button 97 is depressed, such as with a thumb of a user grasping the bottom beam 40 of the window shade 10, the assembly 95 including the rod 96, button 97 and shoe 98 all translate horizontally and the bias spring 99 is compressed. The cord 50 is thus released and allowed to be freely drawn onto the retainer 70 or fed off of the retainer 70. In effect, pushing the button 97 activates the retractor 80 and releasing the button 97 deactivates the retractor 80. The button 97 thus provides a means to manually activate and deactivate the retractor 80.

With particular reference to FIGS. 1–3 and 6–8, details of the operation of the window shade 10 of this invention are described. Initially, the window shade 10 is provided in a raised form with the bottom beam 40 adjacent the top beam 30. The top beam 30 is fastened to the top T of the frame F adjacent the window W (FIG. 1). When a user wishes to lower the window shade 10 (along arrow D of FIG. 1), the user simultaneously grasps the bottom beam 40 with thumbs of a user adjacent the buttons 97 associated with each of the height adjustment control mechanisms within the bottom beam 40. After the buttons 97 have been depressed (along arrow A of FIG. 7), the cord 50 is in a state where it can be pulled off of the spool 72 of the retainer 70. The user can merely pull down on the bottom beam 40 (along arrow D of FIG. 1) with sufficient force to overcome the force exerted by the retractor 80 upon the retainer 70. As this downward force is applied by the user by pulling down on the bottom beam 40, the cord 50 is fed off of the spool 72 (along arrow C of FIG. 7) of the retainer 70, through the cord brake 90 which is still in a deactivated configuration, and takes its position suspending the bottom beam 40 below the top beam 30.

Once the bottom beam 40 of the window shade 10 has been lowered to the desired elevation, the user manually releases the buttons 97 (along arrow B of FIG. 6), causing the cord 50 to be again held by the cord brake 90. If the user wishes to raise the bottom beam 40 of the window shade 10, the user again grasps the bottom beam 40 with thumbs on the buttons 97, and again depresses the buttons 97 (along arrow A of FIG. 7) to release the cord brake 90. The user then simultaneously lifts up on the bottom beam 40 (along arrow E of FIGS. 2 and 3) to lift the bottom beam 40 to the desired elevation. As the bottom beam 40 is lifted, the retractor 80 exerts a force on the retainer 70, causing the spool 72 of the retainer 70 to rotate and draw up the excess cord 50 below the cord brake 90 onto the spool 72 of the retainer 70. When the desired height for the bottom beam 40 has again been achieved, the user releases the buttons 97 (along arrow B of FIG. 8) and the cord 50 is again grasped by the cord brake 90 so that the bottom beam 40 is held in place at the new desired elevation.

The two buttons 97 and ends of the bottom beam 40 typically move together to keep the bottom beam 40 horizontal. However, if the bottom beam 40 gets skewed away from horizontal, one button 97 can be depressed and the associated side of the shade 10 adjusted to level the bottom beam 40. Similarly, a non-horizontal orientation can be purposefully attained if desired for the bottom beam 40. Windows W of various non-rectangular shapes can thus be accommodated by the shade 10.

Figure 7:
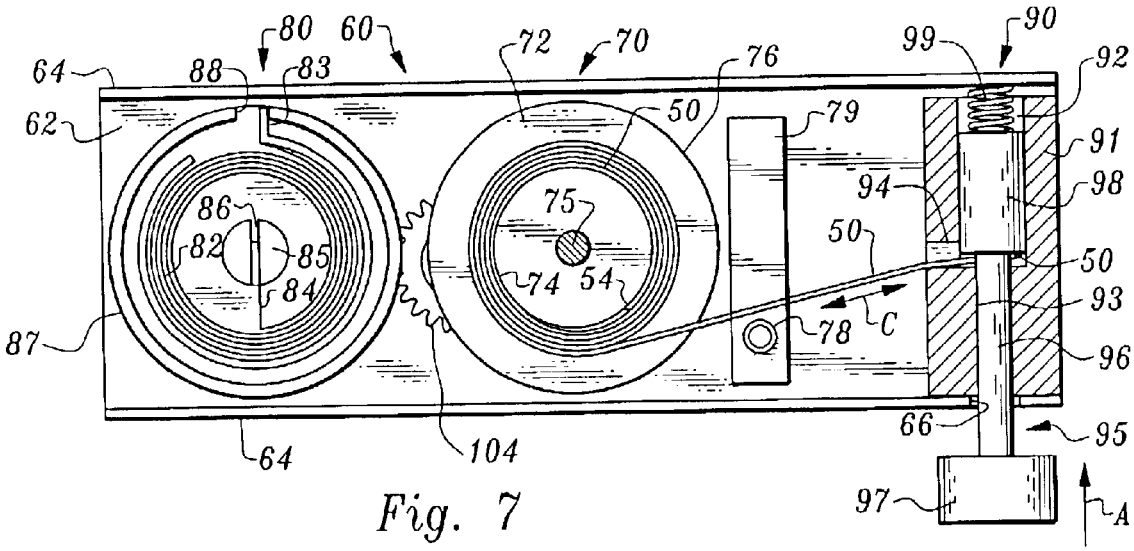
FIG. 7 is a top plan view of that which is shown in FIG. 4, but with the cord brake released and with the cord partially loaded onto the retainer spool and the retractor spring slightly relaxed.

During the elevating and lowering of the bottom beam 40 of the window shade 10, the retainer 70 and retractor 80 experience various different states of operation. For instance, when the bottom beam 40 is at a lowermost position (FIG. 3) the cord 50 is almost entirely off of the spool 72 (FIG. 6) and the spring 82 of the retractor 80 is entirely wound up so that the retractor 80 is at a maximum spool 72 winding energy state. When the bottom beam 40 is in an intermediate position so that the window W is approximately half occluded (FIG. 2) the spool 72 of the retainer 70 is partially filled with the cord 50 and the spring 82 of the retainer 80 is in a partially wound up state (FIG. 7). When the bottom beam 40 is in an uppermost position adjacent the top beam 30, the cord 50 has been entirely wound up onto the spool 72 and the spring 82 of the retractor 80 must be relaxed, but still slightly wound up to keep the spring 82 within its content force range of operation (FIG. 8).

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment.

What is claimed is:

1. A retractable window shade with height adjustment control, comprising in combination:

a shade element adapted to at least partially occlude a window when the shade element is oriented adjacent the window;

said shade element having a top edge spaced above a bottom edge;

at least two cords, said cords spaced laterally from each other;

each said cord having an upper end adjacent said top edge of said shade element and a lower end adjacent said bottom edge of said shade element;

at least two cord retainers coupled to said bottom edge of said shade element;

at least two selectively activatable cord retractors, each said retractor adapted to load one of said cords into said cord retainers when an associated said retractor is activated; and each said retractor including one of at least two cord brakes adjacent said bottom edge of said shade element, said cord brakes spaced from each other and adapted to hold a portion of one of said cords between said cord upper end and said cord lower end adjacent said bottom edge of said shade element when each said retractor associated with each said cord is activated.

2. The window shade of claim 1 wherein said lower end of each said cord is at least indirectly coupled to said bottom edge of said shade element.

3. The window shade of claim 1 wherein each said retractor is located adjacent said bottom edge of said shade element.

4. The window shade of claim 1 wherein each said retractor is adapted to resist release of said associated cord out of said retainer when said retractor is deactivated.

5. The window shade of claim 1 wherein said shade element includes a top beam forming said top edge of said shade element, said top beam configured to be substantially rigid.

6. The window shade of claim 5 wherein said upper end of each said cord is coupled to said top beam.

7. The window shade of claim 5 wherein said top beam includes an upper surface with an adhesive thereon, said adhesive sufficiently strong to suspend the entire window shade from a top of a frame surrounding the window.

8. The window shade of claim 1 wherein said shade element includes a bottom beam coupled to said bottom edge of said shade element, said bottom beam being substantially rigid.

9. The window shade of claim 8 wherein said bottom beam includes a hollow interior and each said retainer is located at least partially inside said hollow interior of said bottom beam.

10. The window shade of claim 9 wherein each said retractor is located at least partially inside said hollow interior of said bottom beam.

11. The window shade of claim 10 wherein said shade element includes a top beam forming said top edge of said shade element, said top beam configured to be substantially rigid;

wherein said upper end of each said cord is coupled to said top beam; and wherein said top beam includes an upper surface with an adhesive thereon, said adhesive sufficiently strong to hold the entire window shade to a top of a frame surrounding the window.

12. The window shade of claim 1 wherein each said retainer includes a spool adapted to have one of said cords wound thereon, each said spool rotatably supported relative to said bottom edge of said shade element.

13. The window shade of claim 1 wherein each said cord brake includes a manually toggleable button.

14. The window shade of claim 13 wherein each said cord brake is configured to be applied to one of said at least two cords, each said cord brake adapted to hold said cord in fixed position relative to said brake when said button is in an undepressed configuration and for each said cord brake to release said cord and activate said retractor when said button is in a depressed configuration.

15. The window shade of claim 1 wherein each said retractor includes a spring coupled to said spool of said retainer, said spring adapted to store spool winding energy when said bottom edge of said shade element is in a lower position and to release spool winding energy to wind said cord onto said spool as said bottom edge of said shade element rises toward said top edge of said shade element.

16. The window shade of claim 15 wherein each said spring is a spiral spring with a central axis aligned with a central shaft, said central shaft oriented parallel with an axis of rotation of each said spool, said central shaft spaced laterally away from said rotational axis of said spool, each said spring of each said retractor coupled to each said spool through at least two spur gears oriented in a common plane with teeth of said at least two spur gears engaging each other, such that energy stored in each said spring exerts a force on each said spool tending to cause each said spool to rotate.

17. The window shade of claim 1 wherein said shade element includes a pleated formed substantially non-foraminous shade surface.

18. The window shade of claim 1 wherein said shade element includes blinds formed of multiple separate slats, said blinds adapted to block less than all light passing through the window adjacent said window shade.

19. A shade for adjustably occluding light through an adjacent window, comprising in combination:

a shade element adapted to at least partially occlude a window when the shade element is oriented adjacent the window;

said shade element having a top edge spaced above a bottom edge;

at least two cords, said cords spaced laterally from each other;

each said cord having an upper end adjacent said top edge of said shade element and a lower end adjacent said bottom edge of said shade element;

a separate pair of means to retain each said cord, each said retaining means coupled to said bottom edge of said shade element;

a separate pair of means to selectively retract each said cord and load each said cord onto said retaining means when each said means to selectively retract is activated;

wherein said pair of selective retraction means includes a separate pair of means to releasably hold one of said cords at a middle location on said cord between said upper end of said cord and said lower end of said cord adjacent said bottom edge of said shade; and wherein said pair of releasable holding means each include a cord brake including a shoe frictionally engaging said cord and holding said cord adjacent said bottom edge of said shade when said cord brake is in a first position and releasing said cord when said cord brake is in a second position, each said cord brake including a manually depressable button, each said cord brake moving from said first position to said second position when said button of said cord brake is depressed.

20. A shade for adjustably occluding light through an adjacent window, comprising in combination:

a shade element adapted to at least partially occlude a window when the shade element is oriented adjacent the window;

said shade element having a top edge spaced above a bottom edge;

at least two cords, said cords spaced laterally from each other;

each said cord having an upper end adjacent said top edge of said shade element and a lower end adjacent said bottom edge of said shade element;

a separate pair of means to retain each said cord, each said retaining means coupled to said bottom edge of said shade element;

a separate pair of means to selectively retract each said cord and load each said cord onto said retaining means when each said means to selectively retract is activated; and wherein said pair of selective retraction means includes a separate pair of means to manually activate and deactivate each said selective retraction means.

21. The shade of claim 20 wherein said pair of manual activation and deactivation means includes at least two cord brakes, each said cord brake selectively abuttable against a portion of one of said cords between said upper end and said lower end, each said cord brake adjacent one of said pair of retaining means, each said cord brake including a button manually depressable to release said cord brake from said cord and apply said cord brake to said cord when said button is undepressed.

22. The shade of claim 19 wherein said pair of selective retraction means includes a separate pair of means to releasably hold each said cord adjacent said bottom edge of said shade at a middle location on each said cord between said upper end of each said cord and said lower end of each said cord.

23. A shade for adjustably occluding light through an adjacent window, comprising in combination:

a shade element adapted to at least partially occlude a window when the shade element is oriented adjacent the window;

said shade element having a top edge spaced above a bottom edge;

at least two cords, said cords spaced laterally from each other;

each said cord having an upper end adjacent said top edge of said shade element and a lower end adjacent said bottom edge of said shade element;

a separate pair of means to retain each said cord, each said retaining means coupled to said bottom edge of said shade element;

a separate pair of means to selectively retract each said cord and load each said cord onto said retaining means when each said means to selectively retract is activated;

wherein said pair of selective retraction means includes a separate pair of means to releasably hold each said cord adjacent said bottom edge of said shade at a middle location on each said cord between said upper end of each said cord and said lower end of each said cord; and wherein said pair of releasable holding means includes at least two cord brakes each including a shoe frictionally engaging one of said cords and holding one of said cords adjacent said bottom edge of said shade when a corresponding said cord brake is in a first position and releasing one of said cords when a corresponding said cord brake is in a second position, each said cord brake including a manually depressable button, said cord brake moving from said first position to said second position when said button of said cord brake is depressed.

24. The shade of claim 19 said pair of selective retraction means each include a spring coupled to one of said pair of retainer means.

25. The shade of claim 24 wherein said pair of retainer means each include a spool rotatably supported relative to said bottom edge of said shade element, each said spool configured to gather up one of said cords thereon when said spool rotates.

26. The shade of claim 25 wherein each said spring is coupled to one of said spools through gears including a drive gear fixed relative to at least one end of said spring and a follower gear fixed to said spool.

27. The shade of claim 26 wherein said shade element includes a bottom beam adjacent said bottom edge of said shade element, said bottom beam rotatably supporting each of said spools, and said bottom beam fixed to an end of each said spring opposite said drive gear.

28. A variable height window shade, comprising in combination:

a shade element adapted to at least partially occlude a window when the shade element is oriented adjacent the window;

said shade element having a top edge spaced above a bottom edge;

at least two cords, said cords spaced laterally from each other;

each said cord having an upper end adjacent said top edge of said shade element and a lower end spaced from said upper end;

at least two cord retainers coupled to said shade element below said top edge;

at least two cord retractors, each said retractor adapted to load one of said cords into one of said cord retainers; and wherein each said retractor includes a cord brake adjacent said bottom edge of said shade element said cord brake adapted to hold a portion of said associated cord between said upper end and said lower end adjacent said bottom edge of said shade element when said retractor is activated.

29. The variable height window shade of claim 28 wherein each said cord retainer includes at least one spool rotatably supported by a portion of said shade element below said top edge of said shade element.

30. The variable height window shade of claim 28 wherein each said cord retractor includes a spring having a first end coupled to a portion of said shade element below said top edge and a second end coupled to said cord retainer, said spring adapted to cause said retainer to store said associated cord onto said retainer when said cord retainer moves upward relative to said top edge of said shade element and to release said associated cord from said cord retainer when said cord retainer moves down away from said top edge of said shade element.

31. The variable height window shade of claim 28 wherein said lower end of each said cord is located adjacent said bottom edge of said shade element.

32. The variable height window shade of claim 28 wherein each said cord retainer is coupled to said bottom edge of said shade element.

33. The variable height window shade of claim 28 wherein each said cord retractor is adapted to be selectively activatable and deactivatable.

34. A method for raising a window shade from a first position to a second position with the first position having a bottom edge of the shade further from a top edge of the shade than said second position, the method including the steps of:

configuring the window shade to include at least two cords spaced from each other and extending at least partially between the top edge of the shade and the bottom edge of the shade with at least two cord retainers coupled to the shade at a location spaced from the top edge and coupled to a portion of one of the cords spaced from an upper end of the associated cord, and at least two cord retractors adapted to cause at least a portion of one of the cords between one of the cord retainers and the upper end of one of the cords to be loaded onto one of the cord retainers;

activating each of the cord retractors, such that the cord retainers have cords loaded thereon and an amount of each cord between each of the cord retainers and the upper end of each cord is reduced, such that a portion of the shade below the top edge is raised up toward the top edge; and wherein said activating the retractors step includes the steps of:

configuring each retractor to include a cord brake which holds one of the cords from passing onto the retainer;

biasing each retainer with the associated retractor toward a retainer orientation with the retainer loaded with one of the cords; and deactivating the associated cord brake to allow the biased cord retainer to gather the associated cord onto the cord retainer.

35. The method of claim 34 including the further step of deactivating one of the cord retractors by reactivating the associated cord brake.

36. The method of claim 34 wherein said activating step includes each step of configuring the cord retractor as a spring, the spring having a first end coupled to the shade and the second end coupled to the associated cord retainer, with the cord retainer configured as a spool rotatably supported relative to said shade.

37. The method of claim 34 wherein said activating step includes the step of configuring each cord brake to include a manually toggleable button to control the cord brake; and depressing the button to deactivate the cord brake and activate the associated cord retractor.

38. The method of claim 34 including the further step of simultaneously depressing one of the buttons to deactivate the associated cord brake and manually lifting a portion of the shade below the top edge up toward the top edge, while excess cord resulting from collapsing a height of the shade is drawn up onto the associated cord retainer by the associated cord retractor; and releasing the button when a desired height for the side of the shade having the button thereon is achieved to reactivate the associated cord brake and hold the corresponding side of the shade in the new position.

* * * * *